US011661163B1

(12) United States Patent
Alby et al.

(10) Patent No.: US 11,661,163 B1
(45) **Date of Patent: *May 30, 2023**

(54) OUTBOARD MOTORS HAVING STEERABLE LOWER GEARCASE

(71) Applicant: Brunswick Corporation, Mettawa, IL (US)

(72) Inventors: Jeremy L. Alby, Oshkosh, WI (US); Darin C. Uppgard, Oshkosh, WI (US); Wayne M. Jaszewski, Jackson, WI (US); Kerry J. Treinen, Malone, WI (US); Randall J. Poirier, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/461,317

(22) Filed: Aug. 30, 2021

Related U.S. Application Data

(63) Continuation of application No. 16/796,388, filed on Feb. 20, 2020, now Pat. No. 11,130,554, which is a (Continued)

(51) Int. Cl.
*B63H 20/16* (2006.01)
*F01P 11/04* (2006.01)
(Continued)

(52) U.S. Cl.
CPC ..... *B63H 20/16* (2013.01); *B63H 20/12* (2013.01); *B63H 20/245* (2013.01); *B63H 20/28* (2013.01);
(Continued)

(58) Field of Classification Search
CPC ..... B63H 20/08; B63H 20/12; B63H 20/16; B63H 20/24; B63H 20/245; B63H 20/28;
(Continued)

(56) References Cited

U.S. PATENT DOCUMENTS 1,161,935 A 11/1915 Heck
1,774,956 A 9/1930 Wilson
(Continued)

FOREIGN PATENT DOCUMENTS

CA 1317165 5/1993
CN 101475050 7/2009
(Continued)

OTHER PUBLICATIONS

Murray, Charles J., Boat drive Increases Usable Onboard Space: Outboard Motor is Mounted Inboard, Reprinted from Design News, Mar. 1989, United States.

*Primary Examiner* — Daniel V Venne
(74) *Attorney, Agent, or Firm* — Andrus Intellectual Property Law, LLP

(57) ABSTRACT

An outboard motor has a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

20 Claims, 12 Drawing Sheets

Related U.S. Application Data continuation of application No. 16/171,490, filed on Oct. 26, 2018, now Pat. No. 10,800,502.

(51) Int. Cl.

| | |
|---|---|
| ***F01N 13/00*** | (2010.01) |
| ***B63H 20/28*** | (2006.01) |
| ***B63H 20/24*** | (2006.01) |
| ***B63H 20/12*** | (2006.01) |
| ***F01P 3/20*** | (2006.01) |

(52) U.S. Cl.

CPC ..... *F01N 13/001* (2013.01); *F01N 13/004* (2013.01); *F01P 3/202* (2013.01); *F01P 11/04* (2013.01); *F01P 2050/12* (2013.01)

(58) Field of Classification Search

CPC ..... B63H 20/34; B63H 2020/08; F01P 3/202; F01P 11/04; F01P 2050/12; F01N 13/001; F01N 13/004

USPC ..... 440/53, 58, 61 S, 76, 88 R, 88 C, 88 D, 440/88 G, 88 J, 88 K, 89 R, 89 B, 89 C, 440/89 D

See application file for complete search history.

(56) References Cited

U.S. PATENT DOCUMENTS

| | | | |
|---|---|---|---|
| 2,372,247 | A | 3/1945 | Pemberton |
| 2,384,436 | A | 9/1945 | Bossen |
| 2,549,481 | A | 4/1951 | Kiekhaefer |
| 2,688,299 | A | 9/1954 | Gload et al. |
| 2,804,838 | A | 9/1957 | Moser |
| 2,732,819 | A | 3/1959 | Harris |
| 2,877,733 | A | 3/1959 | Harris |
| 2,902,967 | A | 9/1959 | Wanzer |
| 3,021,725 | A | 2/1962 | Schneider |
| 3,084,657 | A | 4/1963 | Kiekhaefer |
| 3,094,967 | A | 6/1963 | Willis |
| 3,164,122 | A | 1/1965 | Morris |
| 3,171,382 | A | 3/1965 | Bergstedt |
| 3,285,221 | A | 11/1966 | North |
| 3,310,021 | A | 3/1967 | Shimanckas |
| 3,376,842 | A | 4/1968 | Wynne |
| 3,404,586 | A | 10/1968 | Fanstone |
| 3,483,843 | A | 12/1969 | Hawthorne |
| 3,486,478 | A | 12/1969 | Halliday |
| 3,548,775 | A | 12/1970 | Hammond et al. |
| 3,707,939 | A | 1/1973 | Berg |
| 3,738,306 | A | 6/1973 | Pinkerton |
| 3,756,188 | A | 9/1973 | Smith |
| 3,795,219 | A | 3/1974 | Peterson |
| 3,841,257 | A | 10/1974 | Strang |
| 3,881,443 | A | 5/1975 | Hamp |
| 3,896,757 | A | 7/1975 | Kucher |
| 3,930,436 | A | 1/1976 | Hedenberg |
| 3,946,698 | A | 3/1976 | LaFollette et al. |
| 4,276,034 | A | 6/1981 | Kashmerick |
| 4,297,097 | A | 10/1981 | Kiekhaefer |
| 4,323,354 | A | 4/1982 | Blanchard |
| 4,343,612 | A | 8/1982 | Blanchard |
| 4,371,348 | A | 2/1983 | Blanchard |
| 4,418,633 | A | 12/1983 | Krautkremer et al. |
| 4,619,548 | A | 10/1986 | Kazaoka et al. |
| 4,668,195 | A | 5/1987 | Smith |
| 4,747,795 | A | 5/1988 | Kawamura et al. |
| 4,887,982 | A | 12/1989 | Newman et al. |
| 4,907,994 | A | 3/1990 | Jones |
| 4,911,666 | A | 3/1990 | Gage et al. |
| 4,932,907 | A | 6/1990 | Newman et al. |
| 5,024,639 | A | 6/1991 | Crispo |
| 5,108,325 | A | 4/1992 | Livingston et al. |
| 5,112,256 | A | 5/1992 | Clement |
| 5,224,888 | A | 7/1993 | Fujimoto et al. |
| 5,280,708 | A | 1/1994 | Sougawa et al. |
| 5,463,990 | A | 11/1995 | Rush, II et al. |
| 5,465,633 | A | 11/1995 | Bernloehr |
| 5,480,330 | A | 1/1996 | Brown |
| 5,487,687 | A | 1/1996 | Idzikowski et al. |
| 5,522,744 | A | 6/1996 | Schlogel |
| 5,540,606 | A | 7/1996 | Strayhorn |
| 5,660,571 | A | 8/1997 | Nakayasu et al. |
| 5,674,099 | A | 10/1997 | Muramatsu et al. |
| 5,711,742 | A | 1/1998 | Leinonen et al. |
| 5,743,774 | A | 4/1998 | Adachi et al. |
| 6,146,220 | A | 11/2000 | Alby et al. |
| 6,183,321 | B1 | 2/2001 | Alby et al. |
| 6,286,845 | B1 | 9/2001 | Lin |
| 6,402,577 | B1 | 6/2002 | Treinen et al. |
| 6,431,928 | B1 | 8/2002 | Aarnivuo |
| 6,554,083 | B1 | 4/2003 | Kerstetter |
| 6,609,939 | B1 | 8/2003 | Towner et al. |
| 7,163,427 | B1 | 1/2007 | Lee |
| 7,244,152 | B1 | 7/2007 | Uppgard |
| 7,267,587 | B2 | 9/2007 | Oguma et al. |
| 7,290,638 | B2 | 11/2007 | Shiino et al. |
| 7,387,556 | B1 | 6/2008 | Davis |
| 7,517,262 | B2 | 4/2009 | Mizutani |
| 7,527,537 | B2 | 5/2009 | Mizutani |
| 7,588,473 | B2 * | 9/2009 | Beachy Head ..... B63H 5/1252 440/53 |
| 7,641,527 | B1 | 1/2010 | Balaji et al. |
| 7,662,005 | B2 * | 2/2010 | Provost ..... B63H 20/34 440/58 |
| 7,794,295 | B2 | 9/2010 | Beachy Head |
| 7,871,302 | B2 | 1/2011 | Provost |
| 7,886,678 | B2 | 2/2011 | Mizutani |
| 8,118,630 | B2 | 2/2012 | Konakawa et al. |
| 8,118,701 | B2 | 2/2012 | Okabe et al. |
| 8,142,247 | B2 | 3/2012 | Konakawa et al. |
| 8,157,694 | B2 | 4/2012 | Nakamura et al. |
| 8,246,398 | B2 | 8/2012 | Inaba |
| 8,246,399 | B2 | 8/2012 | Inaba |
| 8,327,789 | B2 | 12/2012 | Emch |
| 8,425,373 | B2 | 4/2013 | Okabe et al. |
| 8,485,854 | B2 | 7/2013 | Gallato et al. |
| 8,651,904 | B2 | 2/2014 | Pellegrinetti et al. |
| 8,690,616 | B2 | 4/2014 | Grassi et al. |
| 8,715,021 | B2 | 5/2014 | Horkko et al. |
| 8,795,011 | B2 | 8/2014 | Takase et al. |
| 8,808,045 | B2 | 8/2014 | Lundqvist et al. |
| 9,233,743 | B2 | 1/2016 | Daikoku et al. |
| 9,296,458 | B2 | 3/2016 | Saruwatari et al. |
| 9,475,560 | B1 | 10/2016 | Jaszewski et al. |
| 9,776,700 | B2 * | 10/2017 | Beachy Head ..... B63H 20/20 |
| 9,809,289 | B2 | 11/2017 | Nutt et al. |
| 9,896,175 | B2 | 2/2018 | Galletta, Jr. |
| 10,215,278 | B1 | 2/2019 | Techscherer et al. |
| 10,315,747 | B1 | 6/2019 | Jaszewski et al. |
| 10,392,091 | B2 | 8/2019 | Galletta, Jr. |
| 10,752,328 | B1 | 8/2020 | Bielefeld et al. |
| 10,800,502 | B1 | 10/2020 | Alby et al. |
| 11,068,297 | B2 | 7/2021 | Galletta, Jr. |
| 11,130,554 | B1 | 9/2021 | Alby et al. |
| 11,292,568 | B2 | 4/2022 | Galletta, Jr. |
| 2007/0004294 | A1 | 1/2007 | Mansfield et al. |
| 2013/0045648 | A1 | 2/2013 | Kinpara et al. |
| 2021/0339839 | A1 | 11/2021 | Galletta, Jr. |

FOREIGN PATENT DOCUMENTS

| | | |
|---|---|---|
| WO | 2007020906 | 2/2007 |
| WO | 2017223240 | 12/2017 |

* cited by examiner

OUTBOARD MOTORS HAVING STEERABLE LOWER GEARCASE

CROSS-REFERENCE TO RELATED APPLICATIONS

The present application is a continuation of U.S. application Ser. No. 16/796,388, filed Feb. 20, 2020, now U.S. Pat. No. 11,130,552, which '388 application is a continuation of U.S. application Ser. No. 16/171,490, filed Oct. 26, 2018, now U.S. Pat. No. 10,800,502, issued Oct. 13, 2020. Both applications are hereby incorporated by reference in their entirety.

FIELD

The present disclosure relates to outboard motors, and more particularly to outboard motors having a lower gearcase that is steerable with respect to a powerhead.

BACKGROUND

The following U.S. Patents are incorporated herein by reference in entirety:

U.S. Pat. No. 5,224,888 discloses a boat outboard propulsion assembly having an engine mounted on an engine support which, in turn, is secured to a swivel bracket adapted to be secured to a transom of a boat. Between the engine support and the engine, a steering bracket is provided which is attached to a propulsion unit that is pivotally supported by the engine support such that steering of the boat is accomplished by pivoting of the propulsion unit while the engine remains fixedly secured relative to the swivel bracket. The output drive shaft of the engine extends through the steering bracket and is connected to the propulsion unit. Engine exhaust gases are channeled through the steering bracket and the propulsion unit.

U.S. Pat. No. 5,487,687 discloses an outboard marine drive having a midsection between the upper powerhead and the lower gear case and having a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drain arrangement providing clean oil draining while the outboard drive is mounted on a boat and in the water.

U.S. Pat. No. 6,183,321 discloses an outboard motor having a pedestal that is attached to a transom of a boat, a motor support platform that is attached to the outboard motor and a steering mechanism that is attached to both the pedestal and the motor support platform. A hydraulic tilting mechanism is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 7,244,152 discloses an adapter system provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

U.S. Pat. No. 8,246,398 discloses an outboard marine motor including an upper case enclosing an engine and a lower case fitted with a propeller and connected to a lower end of the upper case. The lower case is configured to be turned relative to the upper case around a vertical axial line. The power of the engine is transmitted to the propeller via a vertical drive shaft which is coaxial with the vertical axial line. Thereby, the outboard marine motor can be steered simply by turning the lower case.

U.S. Pat. No. 9,475,560 discloses an outboard motor having an internal combustion engine, and an adapter plate having an upper end that supports the engine and a lower end formed as a cylindrical neck. A driveshaft housing has an integral oil sump collecting oil that drains from the engine and through the adapter plate neck. One or more bearings couple the adapter plate neck to the oil sump such that the driveshaft housing is suspended from and rotatable with respect to the adapter plate. A driveshaft is coupled to a crankshaft of the engine, and extends along a driveshaft axis through the adapter plate neck, bearing(s), and oil sump. A steering actuator is coupled to and rotates the oil sump, and thus the driveshaft housing, around the driveshaft axis with respect to the adapter plate, which varies a direction of the outboard motor's thrust.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples disclosed herein, an outboard motor has a powerhead that causes rotation of a driveshaft; a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

BRIEF DESCRIPTION OF THE DRAWING

The present disclosure is described with reference to the following Figures. The same numbers are used throughout the Figures to reference like features and like components.

DETAILED DESCRIPTION

Figure 1:
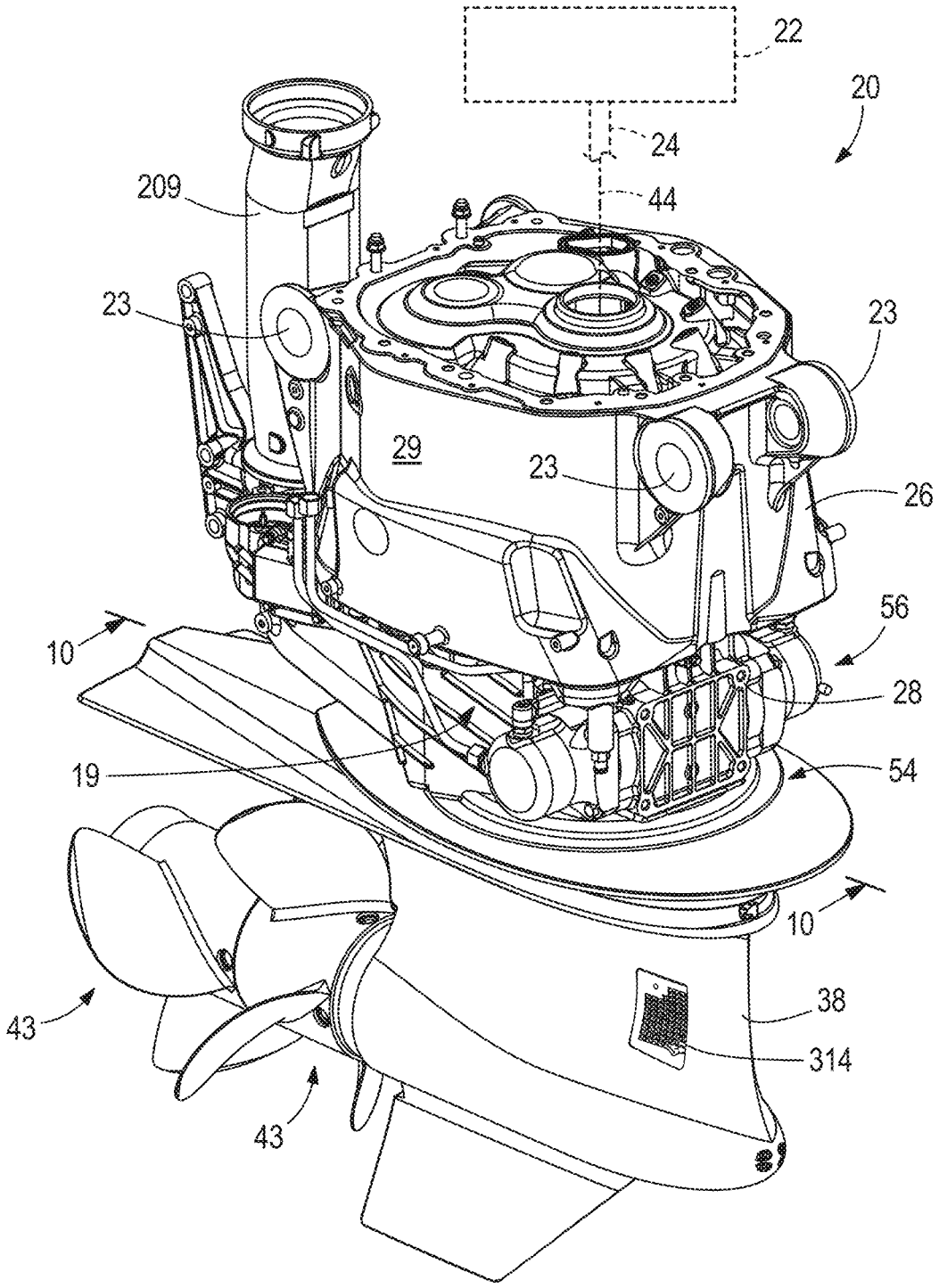
FIG. 1 is a perspective view of a driveshaft housing, steering housing and lower gearcase of an outboard motor according to a first embodiment of the present disclosure.

Conventional outboard motors typically are steerable about a steering axis with respect to a marine vessel so as to change the direction of thrust produced by the outboard motor and thereby vary the direction of travel. In addition, conventional outboard motors typically are tilt-able (trim-able) about a horizontal trim axis so as to redirect the direction of thrust upwardly or downwardly and thereby vary the attitude of the marine vessel in the water. Examples of such configurations are disclosed in the above-incorporated U.S. patents.

During research and development, the present inventors have identified that a current trend in the marketplace is to provide outboard motors having a relatively large size, particularly in the area of the powerhead. This is to meet consumer demand for more power. This trend presents challenges for boat designers and boat owners because the available design-space for mounting outboard motors on marine vessels is relatively small. When installing new larger-sized outboard motors on a marine vessel, designers and owners often want to use existing mounting locations on the transom of the marine vessel. However the distance between the centerlines of these mounting locations is often only about twenty-six inches, which may not provide enough room for turning, tilting, and trimming movements of larger-sized outboard motors, especially in multiple-outboard-motor configurations. When an operator of a marine vessel steers two or more adjacent larger-sized outboard motors about their steering axes, the outboard motors may collide. Such interference can also be incurred when the outboard motors are tilted or trimmed about their horizontal trim axes.

Additionally, some consumers wish to install four or more outboard motors on a marine vessel. Marine vessels are generally limited in overall width for a number of reasons, and fitting this many outboard motors on a single transom can be difficult, especially when their respective powerheads are large. Other cases where outboard motors have the potential to interfere with one another include marine vessels having less than twenty-six-inch mounting centerlines, or in cases where V-shaped engines (especially in the two hundred-plus horsepower range) are used. V-Shaped engines are often significantly wider than inline engines. Additionally, it would be desirable to be able to mount smaller engines (such as inline six-cylinder engines) on centerlines that are less than twenty-six inches from one another.

Further, the present inventors have identified that as outboard motors are designed with larger size, the distance of the larger mass and center of gravity of the outboard motor from the transom, and more importantly from the steering axis, can have a negative effect on handling. In outboard motor configurations, the mass of the powerhead is attached to the steering rudder by which steering is controlled. Any compliance and/or unwanted motion in the steering through the steering components, structure, and isolation mounts is magnified by the attached mass.

The present inventors determined that the above-described problems could be overcome by providing outboard motor configurations wherein the powerhead remains stationary while the gearcase and associated rudder is steered. This permits less powerhead motion during steering, allows closer mounting of the outboard to the transom, and maintains a large portion of the mass separated from steering motions. This allows the steering axis to be ideally positioned with respect to the gearcase and rudder, independent of the center of gravity of the outboard motor. The present disclosure is a result of the present inventors' efforts to overcome design challenges related to these configurations.

FIGS. 1-6 and 10-14 depict a first embodiment of an outboard motor 20 having a powerhead (shown schematically at 22 in FIG. 1), which for example can include an internal combustion engine and/or any other conventional mechanism for causing rotation of an axially extending driveshaft 24. The driveshaft 24 extends into a driveshaft housing 26 located below the powerhead 22. Optionally, the driveshaft housing 26 contains a sump for containing oil or similar lubricant for the noted internal combustion engine. Optionally the driveshaft 24 is connected to a transmission for engaging forward, reverse and neutral gear positions of the outboard motor 20. Optionally, the driveshaft housing also includes mounting locations 23 for mounting the outboard motor 20 to a supporting cradle that is coupled to a transom bracket and/or the like, for supporting the outboard motor 20 with respect to the transom of a marine vessel. The type and configuration of the driveshaft housing 26 is merely exemplary and can vary from what is shown.

Figure 2:
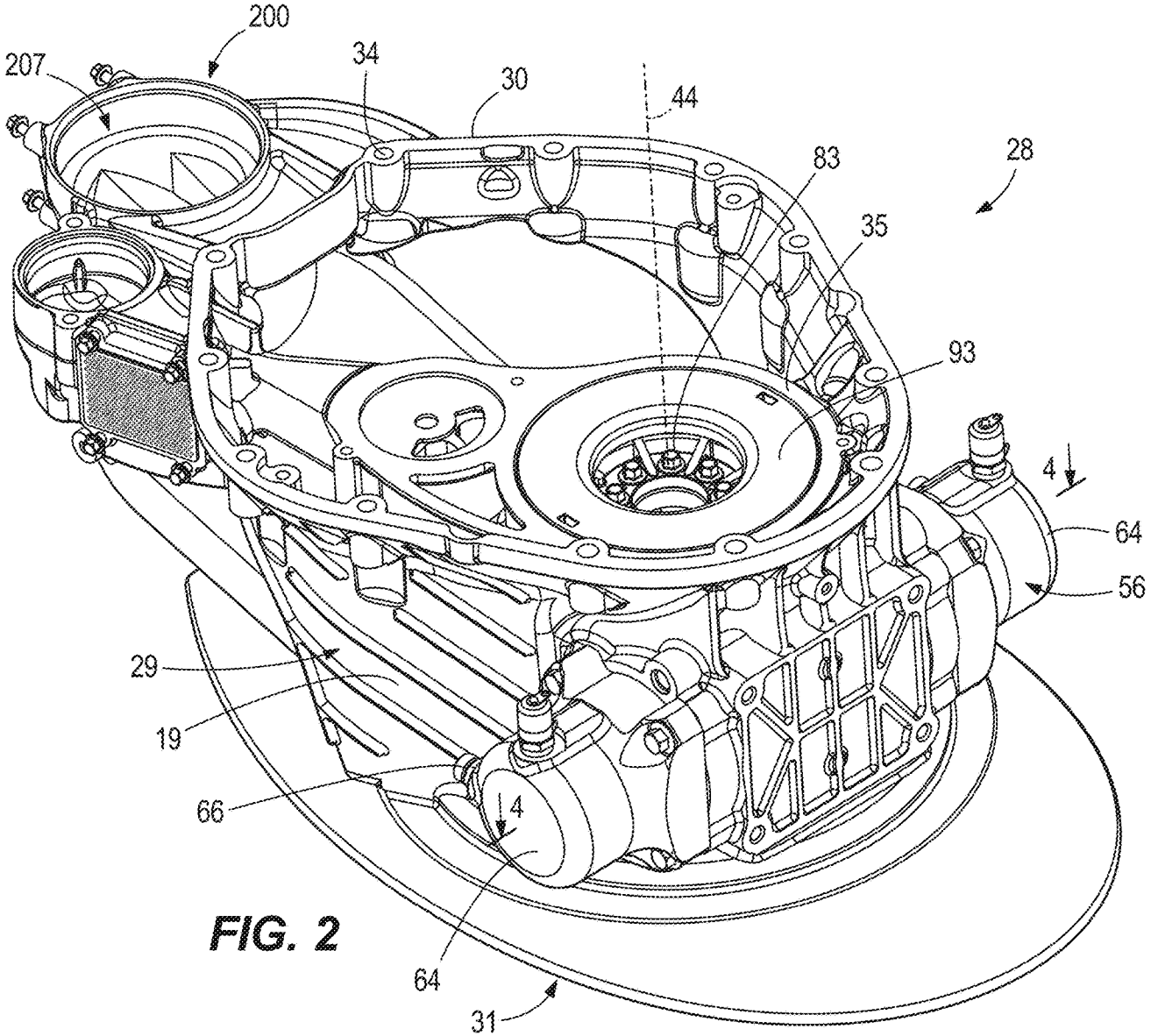
FIG. 2 is a perspective view looking down at a steering housing of the first embodiment.

Referring to FIGS. 1 and 2, a novel steering housing 28 is located below the driveshaft housing 26. The steering housing 28 is a generally oblong member having a main body 29 and upper and lower perimeter mounting flanges 30, 31 (see FIG. 2). The upper perimeter mounting 30 is fixed to the lower perimeter of the driveshaft housing 26 by bolts (not shown) engaged in bolt holes 34. The bolts and bolt holes 34 are spaced apart around the upper perimeter mounting 30, as shown, so that the steering housing 28 and driveshaft housing 26 remain securely fixed together. A center-column 35 defining a through-bore 36 (see FIG. 3) axially extends from top to bottom through the steering housing 28. The driveshaft 24, itself or via an extension member, axially-extends through the through-bore 36. In the illustrated example, the center-column 35 and through-bore 35 are generally cylindrical and contain a bearing arrangement for supporting steering of the outboard motor 20, as will be further described herein below.

Figure 10:
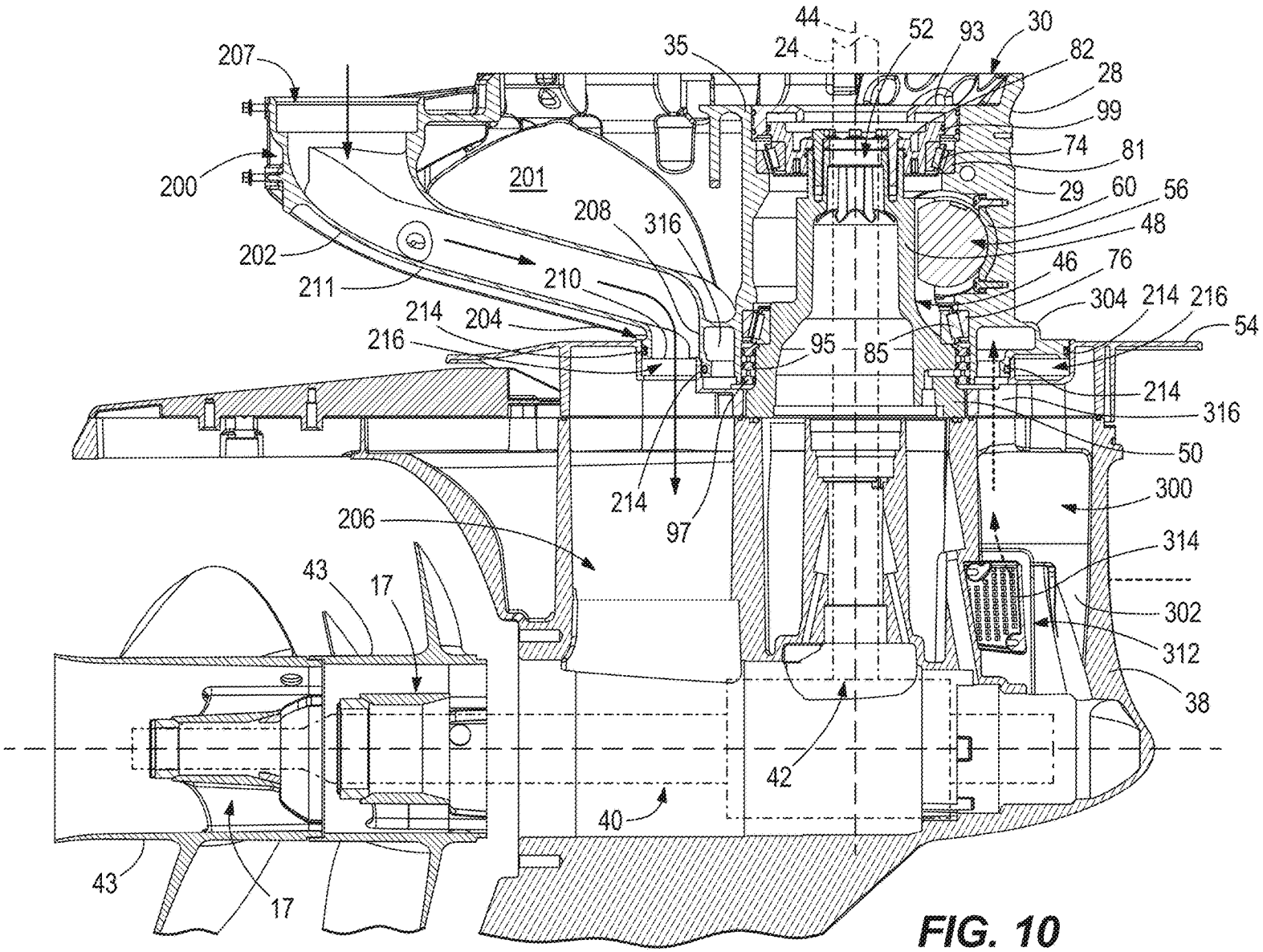
FIG. 10 is a view of section 10-10, taken in FIG. 1, showing flow of exhaust gas and cooling water through the lower gearcase and steering housing of the first embodiment.

Referring to FIGS. 1 and 10, the outboard motor 20 also has a lower gearcase 38, which is located below the steering housing 28 and supports one or more laterally extending propeller shafts (the location of which is shown via dashed lines 40 in FIG. 10). The illustrated example requires a pair of counter-rotating propeller shafts; however arrangements with only one propeller shaft could also be employed. The propeller shafts are coupled to the driveshaft 24, for example directly thereto or via an axial extension thereof, by a conventional angled gearset (the location of which is also shown by dashed lines 42). The angled gearset is configured in the usual way so that rotation of the driveshaft 24 about its own axis causes counter rotation of the propeller shafts about their own laterally extending axes. Counter-rotating propellers 43 are mounted on the pair of propeller shafts, respectively, so that rotation of the propeller shafts 40 causes rotation of the propellers 43. Rotation of the propellers 43 generates thrust forces in water, all as conventional.

Referring to FIGS. 1, 3, 5 and 6, the lower gearcase 38 is a housing that is steerable about a steering axis 44 with respect to the steering housing 28 and powerhead 22. In the illustrated example, the steering axis 44 is coaxial with the driveshaft 24. A steering column 46 (FIG. 3) is fixed to the top of the lower gearcase 38 and extends upwardly into the bottom of the steering housing 28. The steering column 46 is an elongated member having a center column 48 that extends upwardly from a lower perimeter mounting flange 50. A through-bore 52 extends through the center column 48 and defines an open interior in the center column 48. The driveshaft 24 extends through the open interior of the center column 48, into the lower gearcase 38, and into engagement with the noted propeller shafts via the noted angle gearset.

Figure 12:
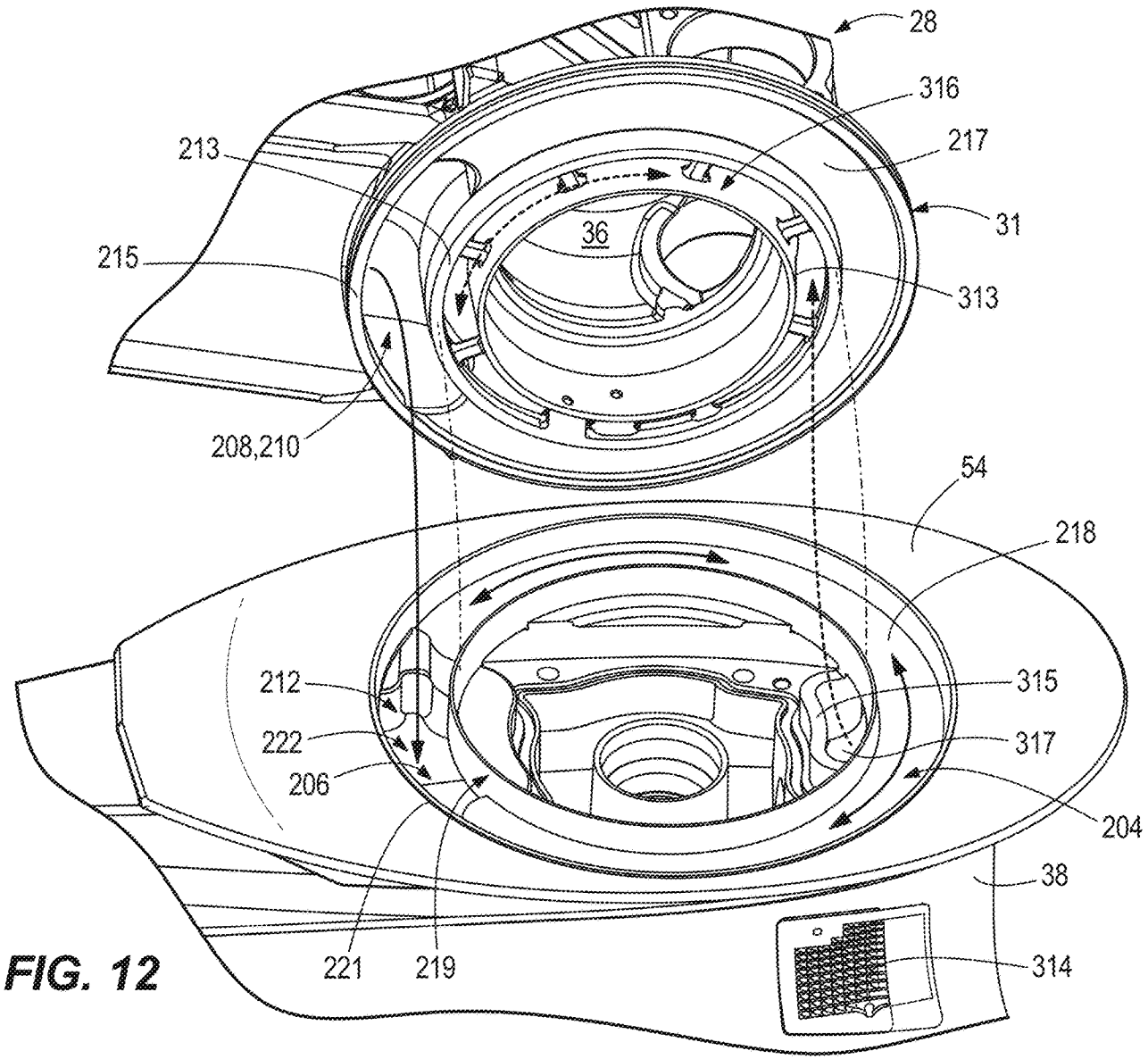
FIG. 12 is an exploded view showing a lower side of the steering housing and a top side of the lower gearcase, and showing flow of the exhaust gas and cooling water from the lower gearcase to the steering housing.

Referring to FIGS. 1, 10, and 12, a gearcase cover 54 is fixed to the top of the lower gearcase 38. Optionally, the gearcase cover 54 is a plate member that is separate component from the lower gearcase 38. The lower perimeter mounting flange 50 of the steering column 46 is coupled to the gearcase cover 54 via bolts (not shown). The bolts extend through bolt-holes 53 (FIG. 3) formed through the lower perimeter mounting flange 50 on the steering column 46 and through the gearcase cover 54, respectively, and fix the gearcase cover 54 with respect to the lower gearcase 38 so that the lower gearcase 38, gearcase cover 54 and steering column 46 rotate together with respect to the steering housing 28. The manner in which the steering column 46 is fixed to the top of the lower gearcase 38 can vary from what is shown and described.

Figure 3:
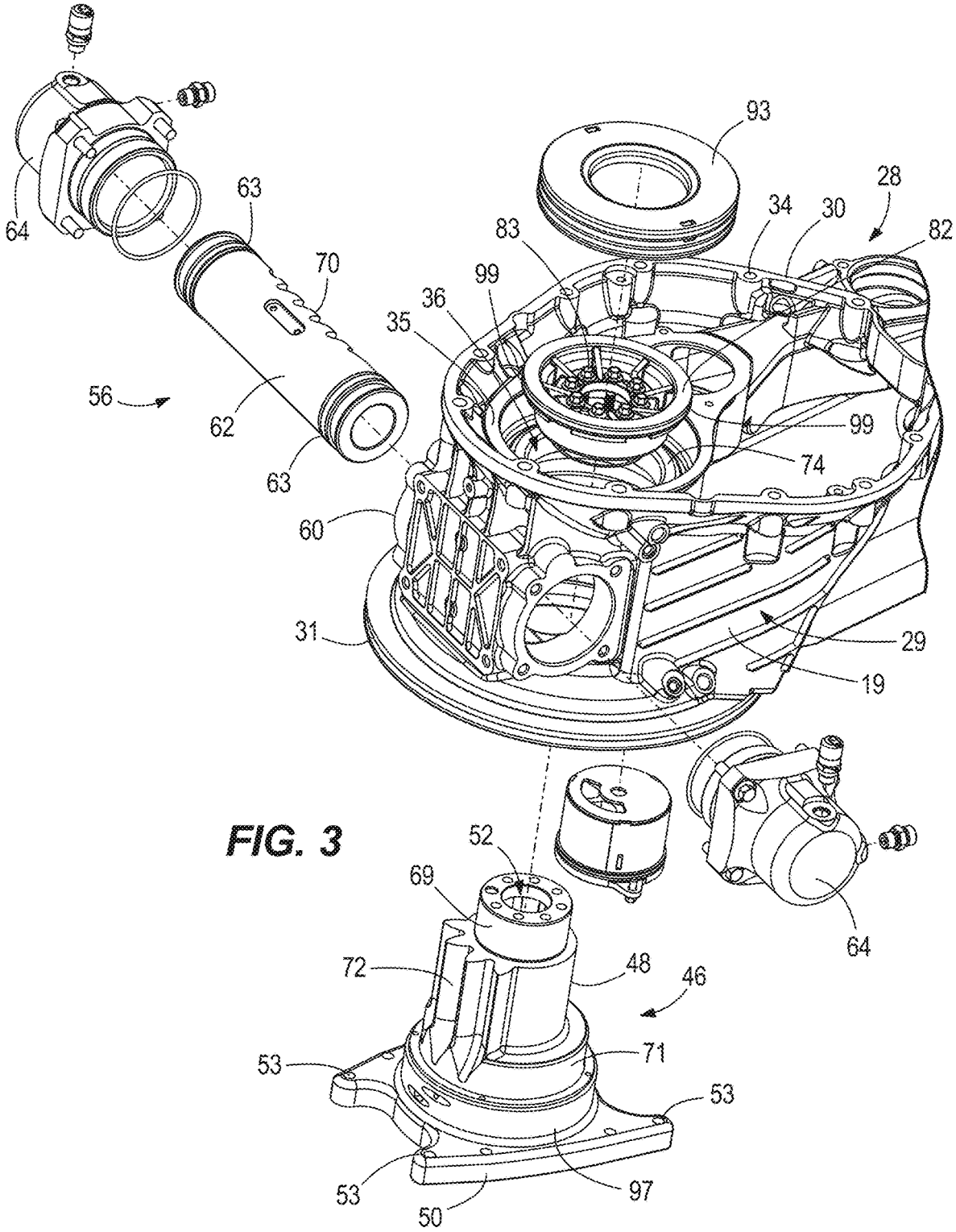
FIG. 3 is an exploded view showing the steering housing, steering actuator, and a steering column according to the first embodiment.
Figure 4:
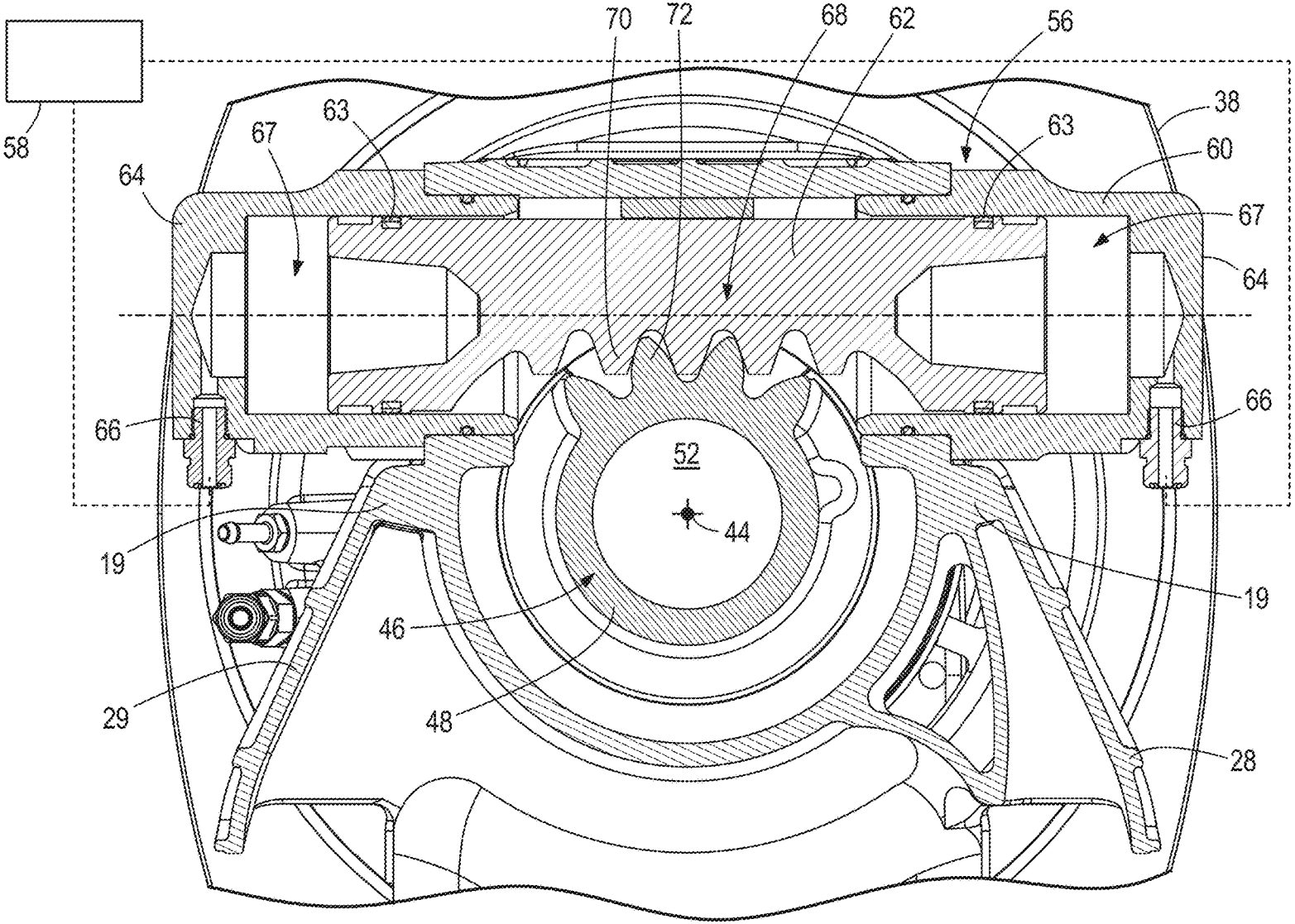
FIG. 4 is a view of section 4-4, taken in FIG. 2.

Referring to FIGS. 3 and 4, a steering actuator 56 is configured to rotate the steering column 46 together with lower gearcase 38 with respect to the steering housing 28 and powerhead 22. The type and configuration of the steering actuator 56 can vary, as will become apparent from the second embodiment described herein below with reference to FIGS. 7-9. In the example shown in FIGS. 3 and 4, the steering actuator 56 is a hydraulically-actuated mechanism which is controlled by a supply of hydraulic fluid from a conventional hydraulic pump 58. The steering actuator 56 has an elongated cylinder 60 to which the pump 58 provides a pressurized supply of hydraulic fluid. In this example, the elongated cylinder 60 is formed in the main body 29 of the steering housing 28 and particularly through opposing sidewalls 19 on opposite sides of the steering housing 28, as shown. The steering actuator 56 further has an elongated piston 62 that is located in the cylinder 60. The piston 62 has radially outer seals 63 that seal with the radially inner sidewalls of the cylinder 60 so as to define opposing fluid chambers 67 in the cylinder 60. The piston 62 is movable (i.e., slide-able) back and forth in the cylinder 60 under pressure from the hydraulic fluid provided by the pump 58. End caps 64 are mounted on sidewalls 19 of the steering housing 28 contain the hydraulic fluid in the respective fluid chambers 67 of the cylinder 60. Opposing inlets 66 are formed in the cylinder 60 and couple the fluid chambers 67 to the pump 58 so that the pump 58 can supply the hydraulic fluid under pressure to opposite sides of the cylinder 60 and thereby cause the piston 62 to forcibly move back and forth in the cylinder 60.

In the example shown in FIGS. 3 and 4, the steering actuator 56 is operably coupled to the steering column 46 by a rack and pinion 68, which in this example includes sets of teeth 70, 72 on the piston 62 and the center column 48 of the steering actuator 56, respectively. The sets of teeth 70, 72 are meshed together so that back-and-forth movement of the piston 62 within the cylinder 60 causes the teeth 70 on the piston 62 to move teeth 72 on the center column 48, which in turn causes corresponding back-and-forth rotational movement of the center column 48 about the steering axis 44. Thus, operation of the steering actuator 56 causes the rack and pinion 68 to rotate the steering column 46 together with the lower gearcase 38 about the steering axis 44 with respect to the steering housing 28 and powerhead 22. The supply of pressurized hydraulic fluid from the pump 58 to the cylinder 60 can be controlled by a conventional valve arrangement and a conventional operator input device for controlling steering movement of an outboard motor, such as a steering wheel, joystick, and/or the like, all as is conventional.

Figure 8:
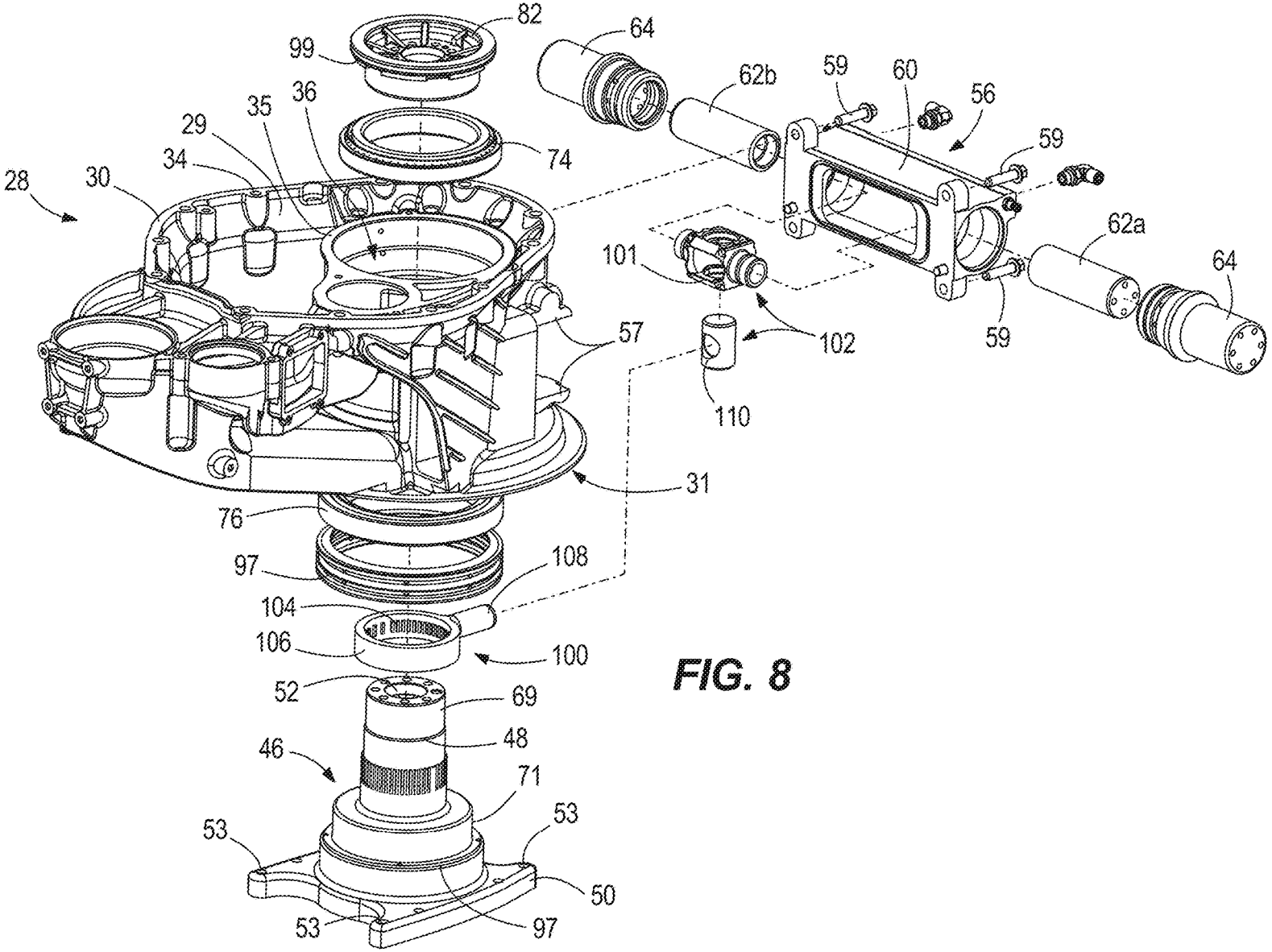
FIG. 8 is an exploded view looking showing the steering housing, steering actuator and a steering column according to the second embodiment.

Referring to FIGS. 3, 8, and 10, upper and lower bearings 74, 76 facilitate smooth rotational movement of the steering column 46 and lower gearcase 38 with respect to the steering housing 28. The upper bearings 74 are located above the rack and pinion 68 between a top end cap 82 having an outer perimeter seal 99 and outer upper bearing surface 69 (FIG. 3) on the steering column 46, and an inner upper bearing surface 81 (FIG. 10) on the center-column 35 in the steering housing 28. The lower bearings 76 are located below the rack and pinion 68 and between a lower outer bearing surface 71 (FIG. 3) on the steering column 46 and a lower inner bearing surface 85 (FIG. 10) in the on the center-column 35. Outer perimeter seals 97 are disposed on a lower sealing surface 97 on the steering column 47. A seal cap 93 (FIG. 3), is disposed on top of the top end cap 82. The upper and lower bearings 74, 76 surround the steering column 46 and are located radially between the steering column 46 and the inner perimeter of the through-bore 36 in the steering housing 28. The type and configuration of the upper and lower bearings 74, 76 can vary from what is shown. In the illustrated example, the upper and lower bearings 74, 76, each comprise inner and outer races containing tapered roller bearings that extend transversely (angular) with respect to the steering axis 44. The top end cap 82 is coupled to the top of the steering column 46 by bolts 83 (FIG. 3) and retains the upper bearings in place.

Figure 6:
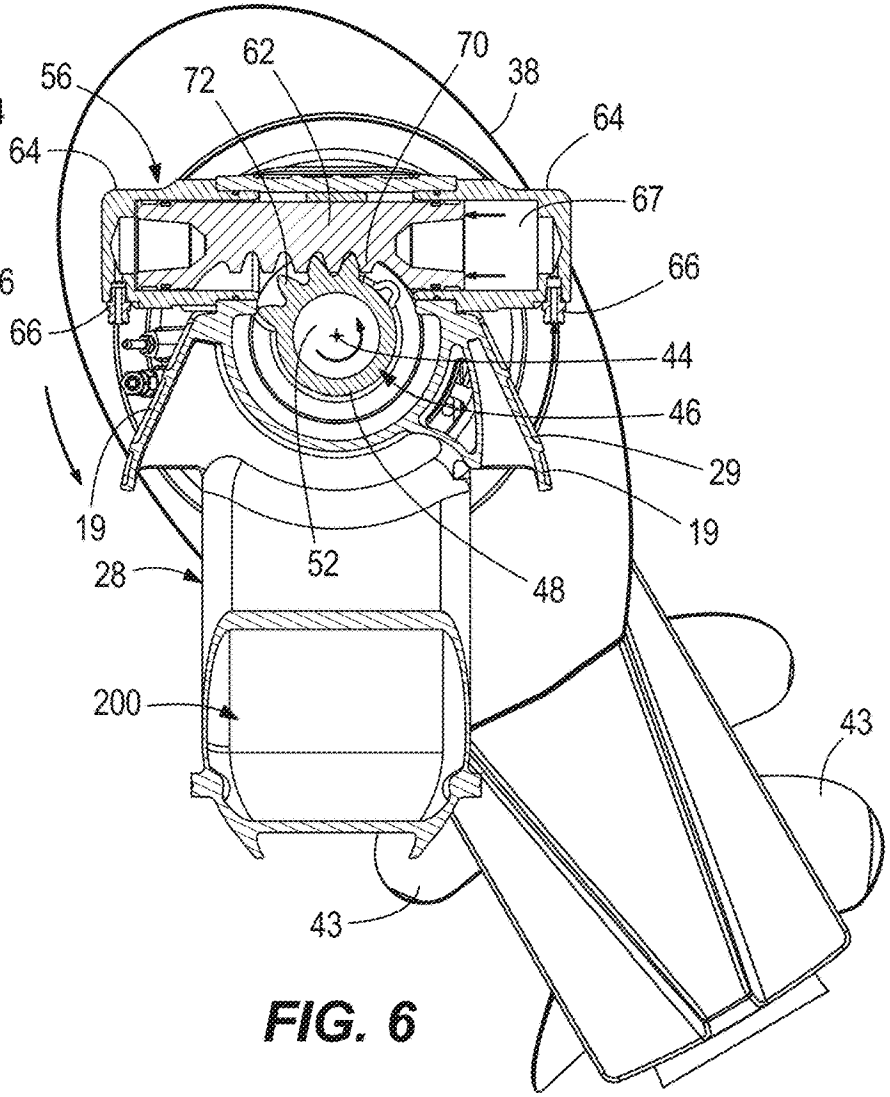
FIGS. 5 and 6 are top views of the first embodiment, via section 4-4, showing steering motions of the lower gearcase with respect to the steering housing.
Figure 5:
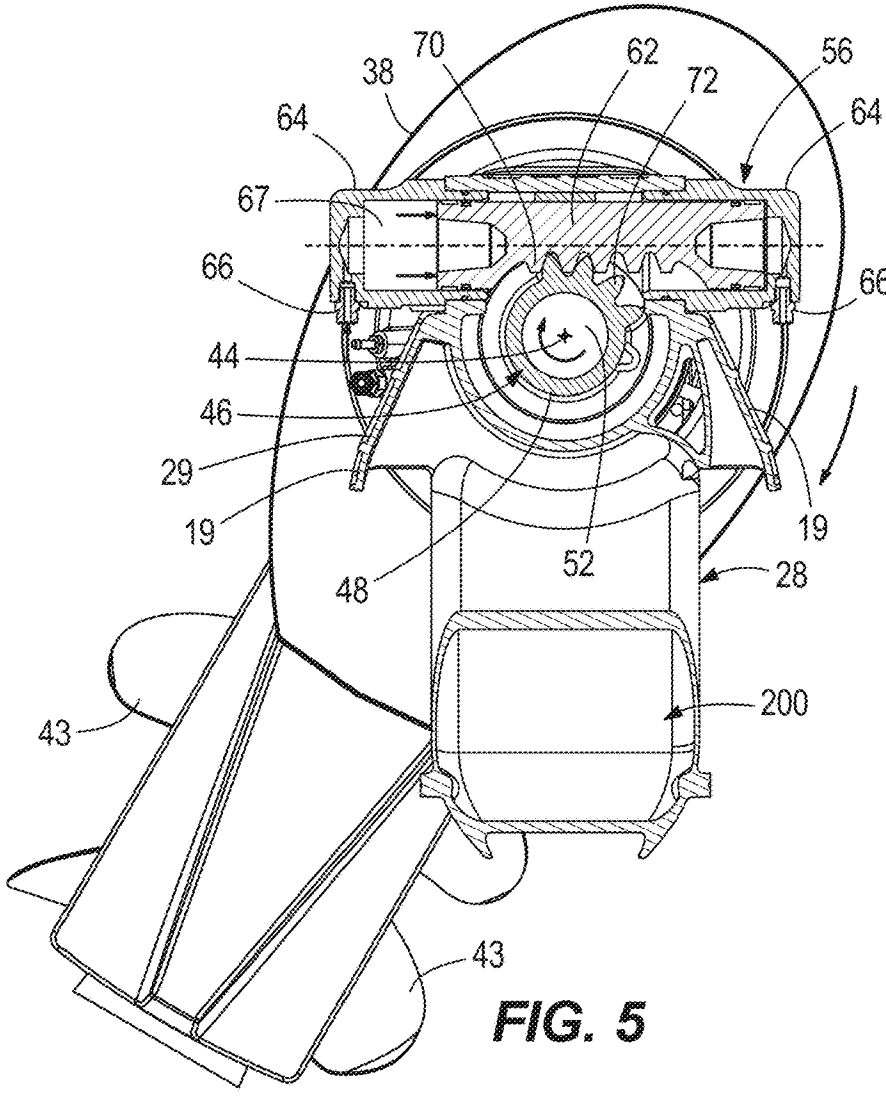

FIGS. 5 and 6 depict steering motions of the lower gearcase 38 with respect to the steering housing 28. In FIG.

5, the noted operator input device controls the pump 58 to supply pressurized hydraulic fluid to the port side chamber 67, which forces the piston 62 to slide to the starboard side, as shown by arrows. Starboard movement of the piston 62 causes the rack and pinion 68 to rotate the steering column 46 and lower gearcase 38 with respect to the steering housing 28, as shown by the arrow. In FIG. 6, the noted operator input device controls the pump 58 to supply pressurized hydraulic fluid to the starboard side chamber 67, which forces the piston 62 to slide to the port side, as shown by the arrow. Port movement of the piston 62 causes the rack and pinion 68 to rotate the steering column 46 and lower gearcase with respect to the steering housing 28, as shown by the arrow.

Figure 7:
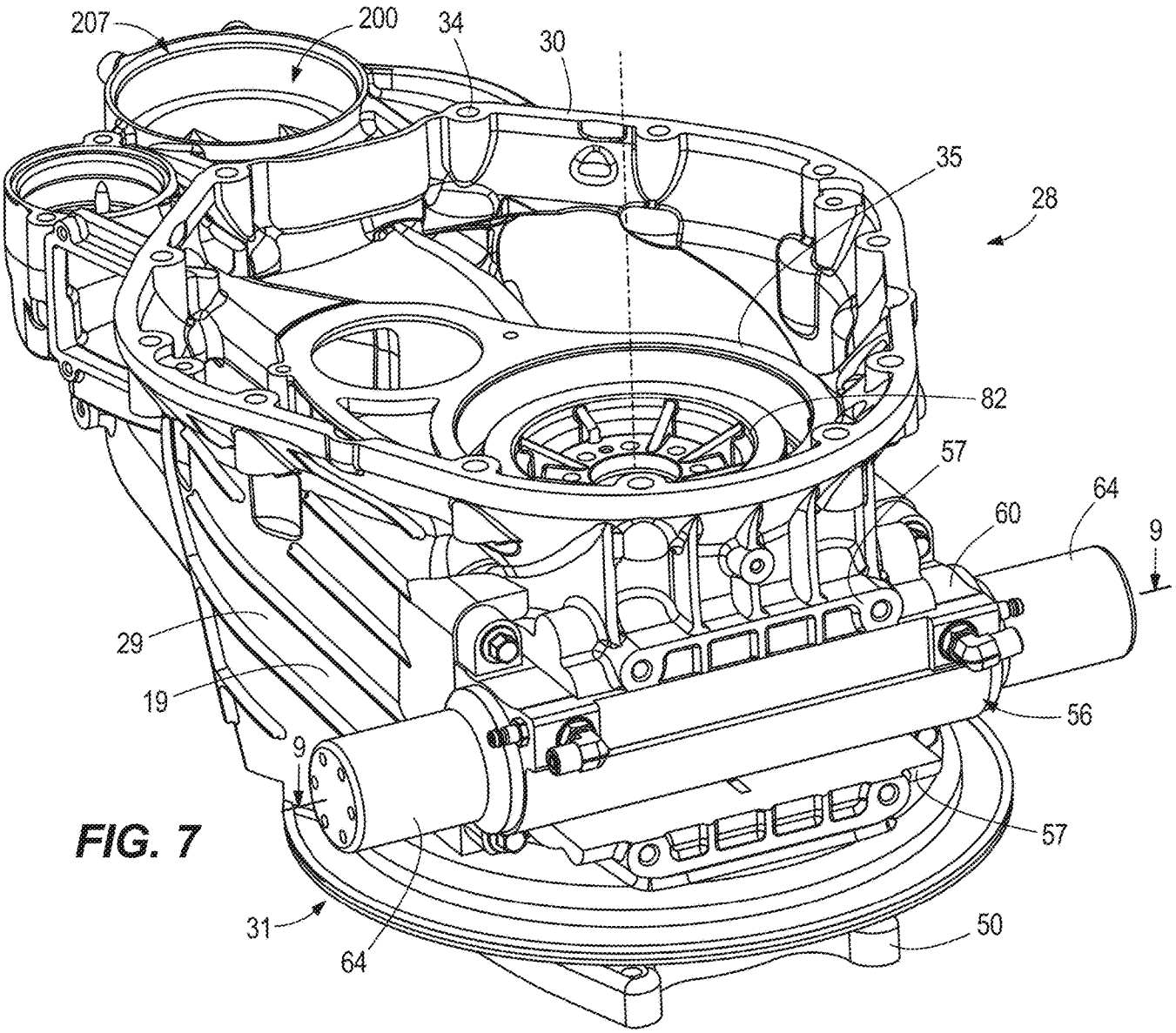
FIG. 7 is a perspective view looking down at a steering housing of an outboard motor according to a second embodiment.
Figure 9:
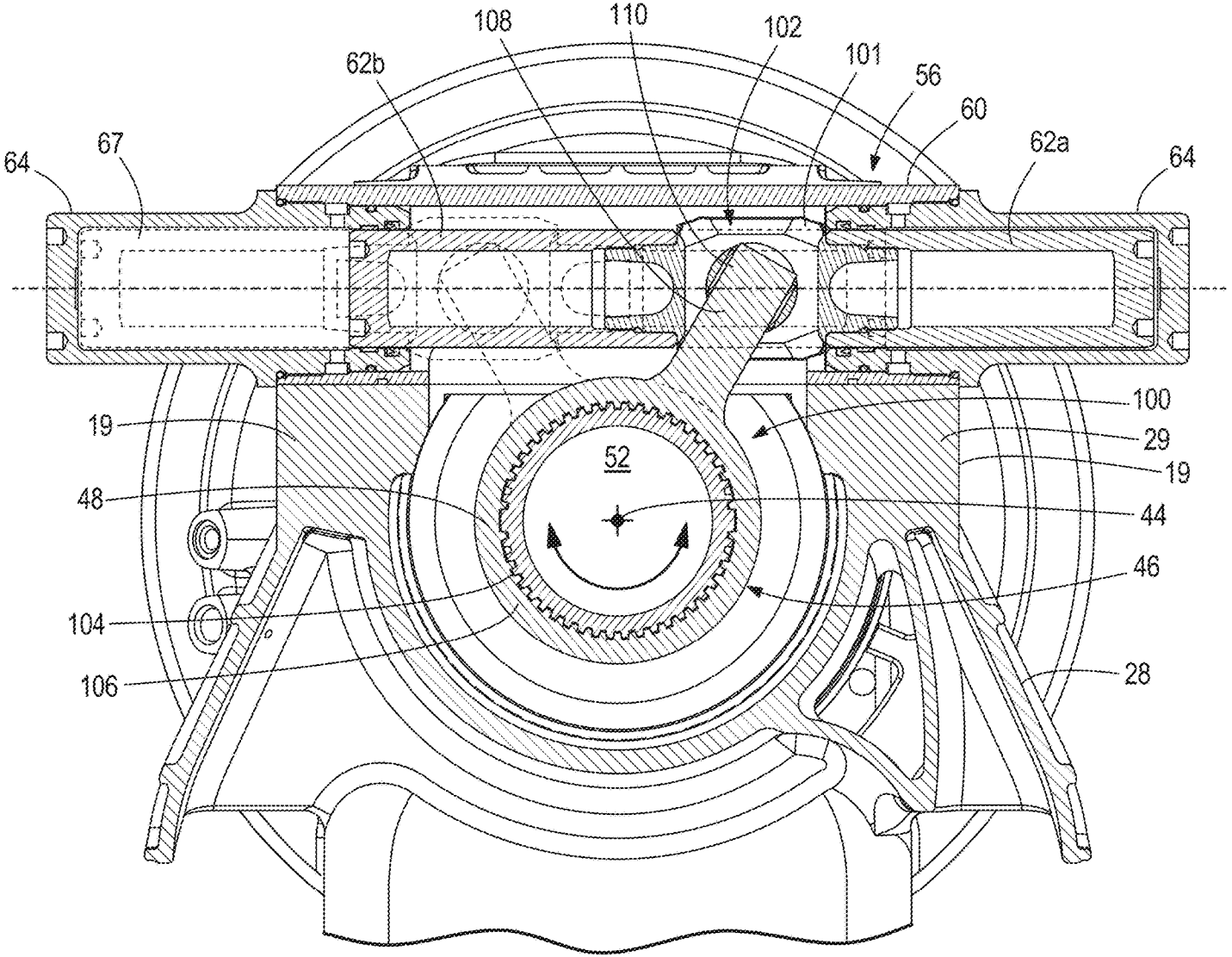
FIG. 9 is a view of section 9-9, taken in FIG. 7.

FIGS. 7-9 depict a second embodiment of the outboard motor 20. Many features that are the same or similar to the first embodiment have like reference numbers in the figures. The second embodiment differs from the first embodiment in that the steering actuator 56 is mounted to an outer surface of the main body 29 of the steering housing 28 by bolts 59, rather than being formed with the main body 29. Mounting flanges 57 outwardly extend on top and bottom of the outer surface and help retain the steering actuator 56 in place. Further, the steering actuator 56 is coupled to the steering column 46 by a yoke 100 and trunnion 102 instead of the rack and pinion 68. The yoke 100 is coupled to the steering column 46 via mated radially-oriented and axially-extending splines 104 disposed on the outer diameter of the steering column 46 and around an inner perimeter of the body 106 of the yoke 100. The yoke 100 has an arm 108 that protrudes from the body 106 via a through-bore in the outer surface of the steering housing 28 and into a rotatable cylinder 110 of the trunnion 102. The body 101 of the trunnion 102 is located in the middle of opposing piston halves 62*a*, 62*b*. Referring to FIG. 9, movement of the piston 62*a*, 62*b* in the cylinder 60 (as described herein above) causes movement of the trunnion 102, via the arm 108 and rotatable cylinder 101, movement of the trunnion 102 causes rotation of the steering column 46, which in turn causes rotation of the lower gearcase 38, as shown. Thus, operation of the steering actuator 56 causes the yoke 100 and trunnion 102 to rotate the steering column 46 and lower gearcase 38 about the steering axis 44 with respect to the steering housing 28 and powerhead 22.

The above-described embodiments thus provide novel outboard motor configurations in which the powerhead remains stationary during steering motion of the lower gearcase and associate rudder.

During further research and experimentation, the present inventors have determined that outboard motor configurations having a steerable lower gearcase present challenges with respect to conveyance of cooling water from the lower gearcase to the powerhead and conveyance of exhaust gas from the powerhead to the lower gearcase. Particularly, the present inventors have identified challenges with respect to how to efficiently and effectively convey the cooling water and the exhaust gas between two components that rotate relative to each other. The present disclosure provides results of the present inventors' efforts to overcome these challenges.

Referring now to FIGS. 10-13, an elongated exhaust conduit 200 conveys exhaust gas from the powerhead 22 through the steering housing 28 and into the lower gearcase 38 for discharge from the outboard motor 20, for example via passageways 17 in the hubs of the propellers 43. Referring to FIG. 10, the exhaust conduit 200 has a first exhaust conduit portion 202 that conveys the exhaust gas through the steering housing 28, a second exhaust conduit portion 204 that conveys the exhaust gas from the steering housing 28 to the lower gearcase 38, and a third exhaust conduit portion 206 that conveys the exhaust gas through the lower gearcase 38 for discharge from the outboard motor 20. The exhaust gas flows from upstream to downstream, and more specifically from the first exhaust conduit portion 202 to the second exhaust conduit portion 204, and then to the third exhaust conduit portion 206. The configuration of the first, second and third exhaust conduit portions 202, 204, 206 can vary from what is shown and described.

In the illustrated example, the first exhaust conduit portion 202 is integrally formed with the steering housing 28 but is located aftwardly of the main body 29 so that a gap 201 exists there between. The first exhaust conduit portion 202 has an upstream end 207 that receives the exhaust gas from an exhaust tube 209 (FIG. 1) located aftwardly of the driveshaft housing 26 (see FIG. 1), a transversely extending middle portion 211 that curves forwardly from the upstream end 207 towards the main body 29, and a downstream end 208 that discharges the exhaust gas to the second exhaust conduit portion 204. Thus, via the first exhaust conduit portion 202, the exhaust gas flows downwardly and forwardly relative to the main body 29 of the steering housing 28, as shown by arrows.

The second exhaust conduit portion 204 annularly extends all the way around the steering column 46 (see FIG. 12). Generally, the second exhaust conduit portion 204 has an upstream end 210 (see FIG. 10) that receives the exhaust gas from the first exhaust conduit portion 202 and a downstream end 212 (see FIG. 12) that discharges the exhaust gas to the third exhaust conduit portion 206. As further described herein below and shown in FIGS. 13 and 14, the downstream end 208 of the first exhaust conduit portion 202 and the upstream end 210 of the second exhaust conduit portion 204 advantageously remain connected as the lower gearcase 38 is steered about the steering axis 44 with respect to the steering housing 28.

Figure 11:
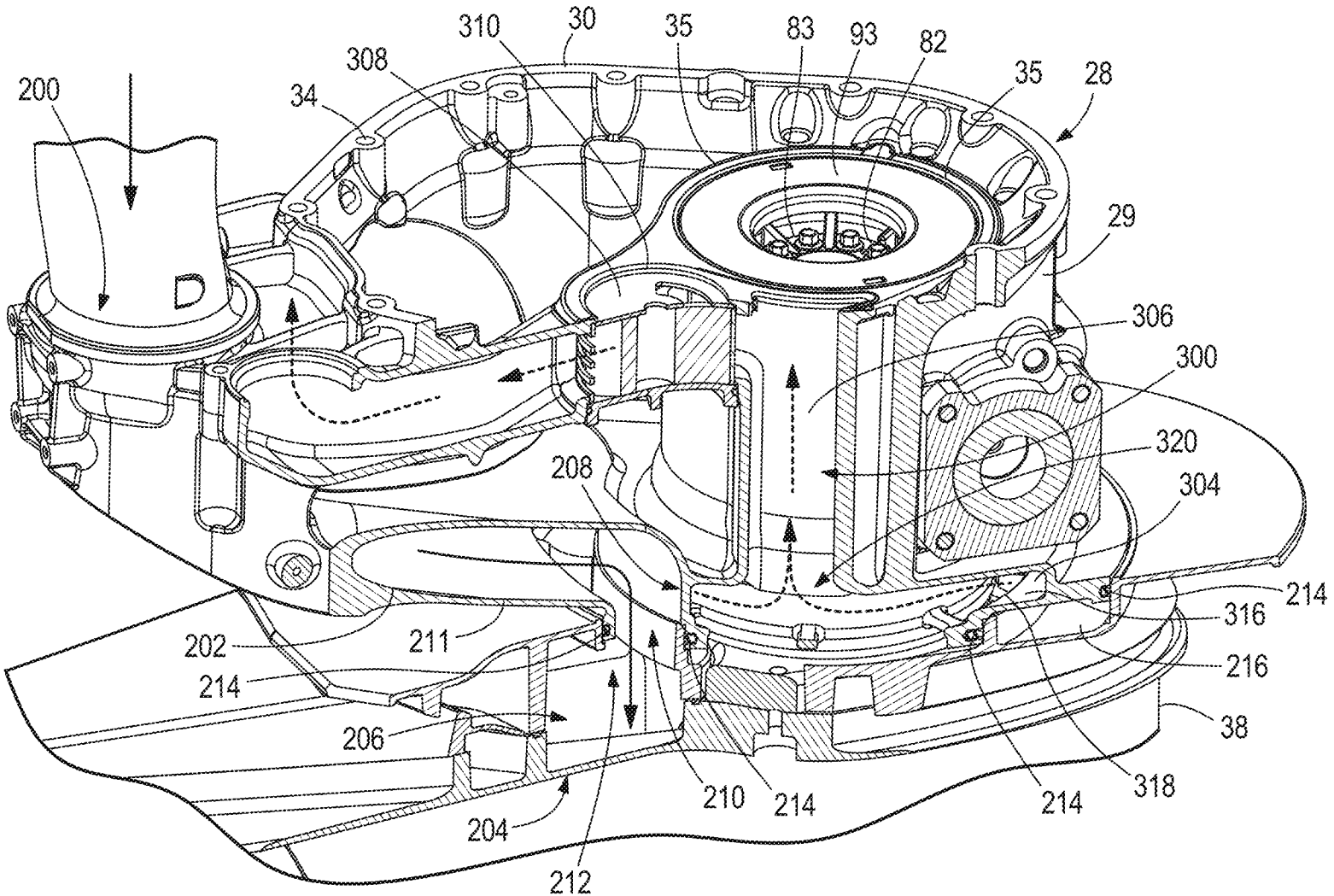
FIG. 11 is a partial sectional view showing flow of the exhaust gas and cooling water through the steering housing of the first embodiment.

As shown in FIGS. 10 and 11, the downstream end 208 of the first exhaust conduit portion 202 axially overlaps with the upstream end 210 of the second exhaust conduit portion 204. Referring to FIG. 12, the bottom of the steering housing 28 has concentric radially inner and outer annular sidewalls 213, 215 that extend downwardly from a bottom face 217 of the steering housing 28 and around an entire periphery of the through-bore 36. Corresponding concentric radially inner and outer annular sidewalls 219, 221 extend upwardly from the gearcase cover 54 and around an entire periphery of the through-bore 36. The annular sidewalls 219, 221 radially overlap and rotate with respect to the annular sidewalls 213, 215 (see e.g., FIG. 10, reference numbers omitted) during steering of the lower gearcase 38 with respect to the steering housing 28. Thus, the second exhaust conduit portion 204 forms an annular channel 216 around the steering column 46, through which the exhaust gas can travel as the exhaust gas is conveyed to the third exhaust conduit portion 206, and as the lower gearcase 38 is steered about the steering axis 44 and with respect to the steering housing 28. The upstream end of the 210 of the second exhaust conduit portion 204 is defined by the annular open top end of the annular channel 216 (see FIG. 12). The annular channel 216 is defined by the annular sidewalls 213, 215, bottom face 217, and an opposing top face 218 of the top of the gearcase cover 54.

Referring to FIGS. 10 and 11, O-ring seals 214 are radially disposed between the annular sidewalls 213 and 219 and 215 and 221, respectively. The O-ring seals 214 advantageously maintain a fluid tight seal between the respective sidewalls, and thus between the first and second exhaust conduit portions 202 and 204, and between the second and third exhaust conduit portions 206 and 206, as the lower gearcase 38 is steered with respect to the steering housing 28. During steering movements, the downstream end 208 of the first exhaust conduit portion 202 advantageously rotates peripherally along the annular channel 216 (see FIGS. 13 and 14) so that the exhaust gas is discharged to the second exhaust conduit portion 204 at a peripheral location along the annular channel 216 that varies depending upon the steering position of the lower gearcase 38 with respect to the steering housing 28. The downstream end 212 of the second exhaust conduit portion 204 is defined by a bore 222 (see FIG. 12) axially extending through the top face 218 along the aftward side of the driveshaft 24. The bore 222 conveys the exhaust gas to the third exhaust conduit portion 206 for discharge from the outboard motor 20, as shown in FIG. 10.

Thus, exhaust gas is conveyed from the powerhead 22 and for discharge from the outboard motor 22 via the exhaust conduit 200 as follows: The exhaust gas is discharged from an exhaust manifold on the powerhead 22 to the exhaust tube 209. The exhaust gas is discharged from the exhaust tube 209 to the first exhaust conduit portion 202. From the first exhaust conduit portion 202, the exhaust gas is discharged downwardly into the annular channel 216 at a location that will vary depending upon the steering position of the lower gearcase 38 with respect to the steering housing 28. The exhaust gas can travel about the annular channel 216 to the bore 222 through which the exhaust gas is discharged to the third exhaust conduit portion 206. From the third exhaust conduit portion 206, the exhaust gas is laterally discharged via the passageways 17 in the propellers 43.

Referring to FIGS. 10 and 11, a cooling water conduit 300 conveys cooling water from the lower gearcase 38 through the steering housing 28 and to the powerhead 22 for cooling of the powerhead 22 and/or other components of the outboard motor 20. In general, the cooling water conduit 300 includes a first cooling water conduit portion 302 (FIG. 10) that conveys the cooling water through the lower gearcase 38, a second cooling water conduit portion 304 that conveys the cooling water out of the lower gearcase 38 and into the steering housing 28, and third cooling water conduit portion 306 (see FIG. 11) that conveys the cooling water through the steering housing 28 and for subsequent conveyance to the powerhead 22 and/or the other components of the outboard motor 20. A cooling water pump 308, which can be a conventional electrically-driven pump or mechanically-driven pump, generates a pumping force which, as described further herein below, draws the cooling water into the outboard motor 20 from the surrounding body of water in which the outboard motor 20 is being operated and pumps the cooling water upwardly in the outboard motor towards the powerhead 22. The cooling water pump 308 thus causes the cooling water to flow from upstream to downstream through the cooling water conduit 300. The location and configuration of the cooling water pump 308 can vary from what is shown. In the illustrated example, the cooling water pump 308 is located in a pump cavity 310, which is defined in the steering housing 28, alongside the center-column 35 of the steering housing 28, and more particularly in direct fluid connection with the third cooling water conduit portion 306.

Referring to FIGS. 10 and 11, the first cooling water conduit portion 302 has an upstream end 312 (FIG. 10) that receives cooling water from the surrounding body of water via intake ports 314 located on opposite sides of the lower gearcase 38. The first cooling water conduit portion 302 has a downstream end 316 located at the top of the lower gearcase 38 and configured to discharge the cooling water to the second cooling water conduit portion 304, as further described herein below. The second cooling water conduit portion 304 has an upstream end 318 (FIG. 11) that receives the cooling water from the downstream end 316 of the first cooling water conduit portion 302, and a downstream end 320 that discharges the cooling water to the third cooling water conduit portion 306. As further described herein below and shown in FIGS. 13 and 14, the downstream end 316 of the first cooling water conduit portion 302 and the upstream end 318 of the second cooling water conduit portion 304 advantageously remain connected as the lower gearcase 38 is steered about the steering axis 44 with respect to the steering housing 28.

Referring to FIGS. 10-14, the downstream end 316 of the first cooling water conduit portion 302 axially overlaps with the upstream end 318 of the second cooling water conduit portion 204. More particularly, as shown in FIG. 12, the bottom of the steering housing 28 has concentric radially inner and outer annular sidewalls 313, 213 that extend downwardly from the bottom of the steering housing 28 and around an entire periphery of the through-bore 36. The annular sidewalls 313, 213 radially overlap and rotate with respect to sidewalls 219, 315 on the lower gearcase 38, during steering of the lower gearcase 38 with respect to the steering housing 28. Thus, the second cooling water portion 304 forms an annular channel 316 around which the cooling water can travel as it is conveyed by the second cooling water conduit portion 304 to the third cooling water portion 306, and as the lower gearcase 38 is steered about the steering axis 44 and with respect to the steering housing 28. The downstream end 316 of the first cooling water conduit portion 302 is defined by the annular open end 317 of the first cooling water conduit portion 304. The annular channel 316 extends around an entire periphery of the driveshaft 24. The downstream end 320 of the second cooling water conduit portion 304 is defined by a bore (FIG. 11) on an aftward side of the driveshaft 24.

Figure 14:
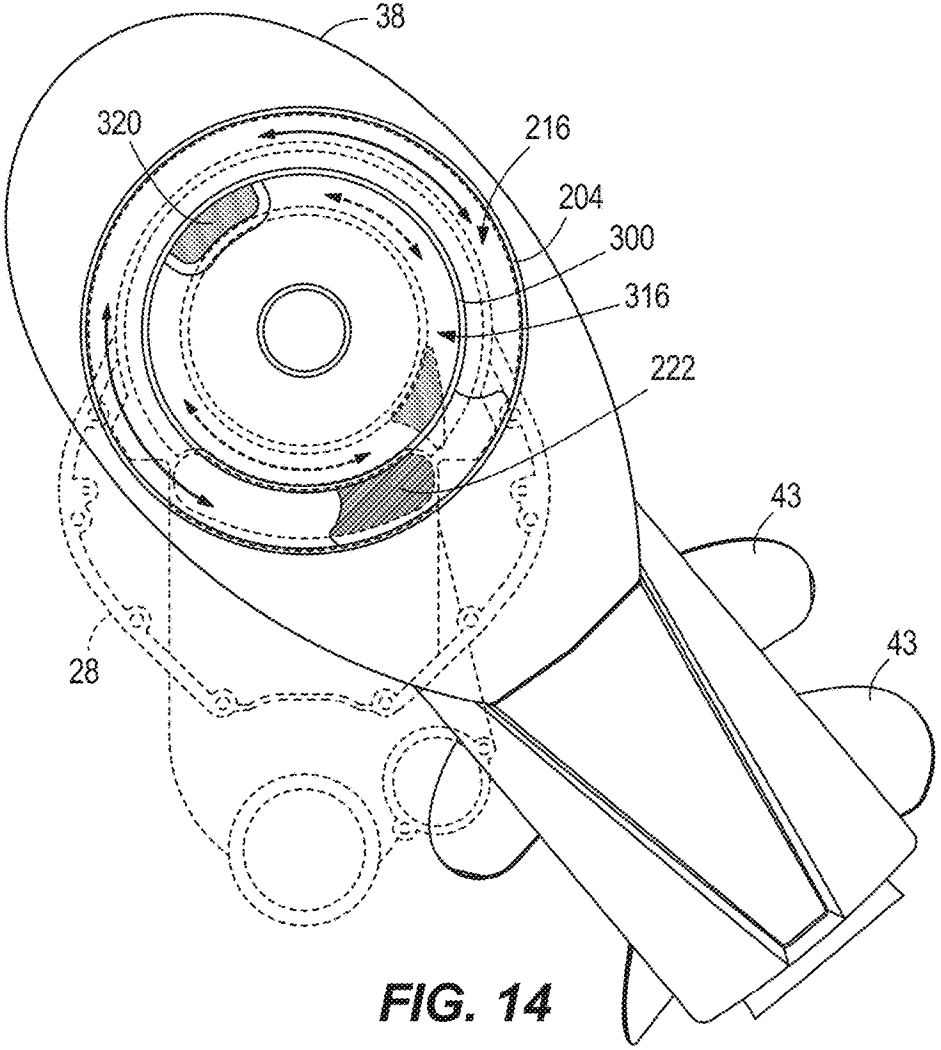
FIGS. 13 and 14 are top views showing flow of the exhaust gas and cooling water between the lower gearcase and steering housing.
Figure 13:
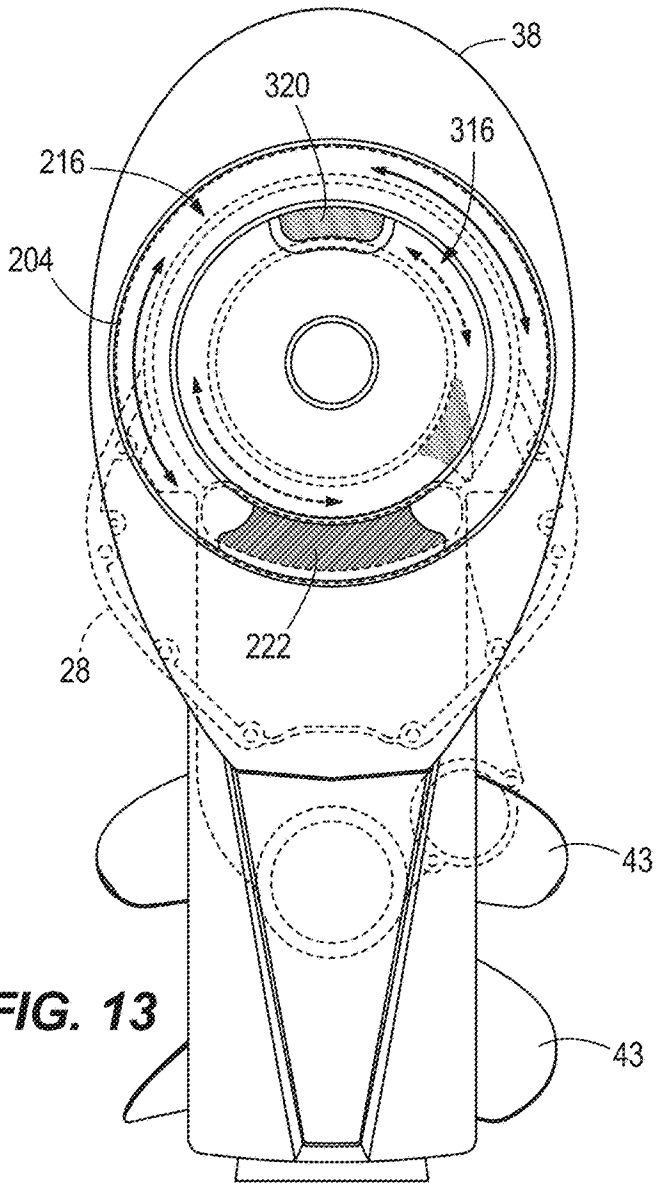

Seals 214 advantageously maintain a fluid tight seal between the respective sidewalls, and thus between the first and second cooling water conduit portions 302 and 304 as the lower gearcase 38 is steered with respect to the steering housing 28. Referring to FIGS. 13 and 14, during steering movements, the downstream end 316 of the first cooling water conduit portion 302 advantageously rotates along the annular channel 316 as that the cooling water is discharged to the second cooling water conduit portion 304 at a radial location along the annular channel 316 that varies depending upon the steering position of the lower gearcase 38 with respect to the steering housing 28.

Thus, the cooling water conduit 300 extends from the lower gearcase 38 towards the powerhead 22, and particularly around an entire periphery of the driveshaft 24. Between the lower gearcase 38 and the powerhead 22, the exhaust conduit 200 and the cooling water conduit 300 are concentric about the driveshaft 24. Between the powerhead 22 and the lower gearcase 38, the exhaust conduit 200 circumscribes the cooling water conduit 300.

Optionally, the configurations shown and described herein above can have steering angular travel limited, for example to ±30°, via for example adjustable hard stops or electronic means. In certain examples, the gearcase can have the ability to turn up to ±47°. This permits the manufacturer of the outboard motor to produce and ship a single outboard motor from the factory to the boat builder, giving the boat builder flexibility to program the outboard motor to steer a certain amount of degrees that is required based on the particular application.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An outboard motor comprising:

a powerhead configured to rotate a driveshaft;

a steering housing located below the powerhead;

a lower gearcase located below the steering housing and supporting a propeller shaft that is operably coupled to the driveshaft so that rotation of the driveshaft causes rotation of the propeller shaft, wherein the lower gearcase is steerable about a steering axis with respect to the steering housing;

a steering column fixed to the lower gearcase and extending upwardly into the steering housing, wherein the driveshaft or an extension thereof extends through the steering column and into the lower gearcase and operably into engagement with the propeller shaft; and a steering actuator coupled to the steering housing, wherein the steering actuator comprises a piston that is movable back and forth in a cylinder, and wherein the piston is engaged with the steering column via a yoke and a trunnion such that back and forth movement of the piston causes rotation of the steering column and the lower gearcase about the steering axis.

2. The outboard motor according to claim 1, wherein the yoke comprises a yoke body that is rotatably fixed to the steering column and a yoke arm that radially extends from the yoke body into engagement with the trunnion such that back and forth linear movement of the trunnion causes back and forth rotational movement of the yoke and the steering column about the steering axis.

3. The outboard motor according to claim 2, wherein the trunnion is coupled to the yoke arm via a cylinder that is rotatable in the trunnion.

4. The outboard motor according to claim 2, wherein the piston comprises a pair of piston halves disposed on opposite sides of the trunnion.

5. The outboard motor according to claim 2, wherein the steering housing comprises a center-column and wherein the steering column extends upwardly into a through-bore in the center-column, and wherein the driveshaft or the extension thereof extends through the steering column and the through-bore in the center-column.

6. The outboard motor according to claim 5, wherein the yoke body is coupled to the steering column via splines.

7. The outboard motor according to claim 2, wherein the steering column comprises a center column extending upwardly from a lower perimeter mounting flange, and wherein a through-bore extends through the center column and defines an open interior in the center column, and wherein the driveshaft or the extension thereof extends through the open interior of the center column, into the lower gearcase and into engagement with the propeller shaft.

8. The outboard motor according to claim 1, wherein the steering actuator is hydraulically-actuated and wherein the piston is movable back and forth in the cylinder under pressure from a hydraulic fluid supplied to the cylinder, and further comprising a pump that supplies the hydraulic fluid to the cylinder.

9. The outboard motor according to claim 1, wherein the cylinder is fastened to the steering housing.

10. The outboard motor according to claim 9, further comprising end caps on opposite sides of the cylinder.

11. The outboard motor according to claim 1, further comprising a set of bearings that facilitate rotation of the steering column and the lower gearcase with respect to the steering housing.

12. The outboard motor according to claim 11, wherein the set of bearings comprises upper bearings located above the yoke and the trunnion and lower bearings located below the yoke and the trunnion.

13. The outboard motor according to claim 12, wherein the upper bearings and the lower bearings surround the steering column and are located radially between the steering column and the steering housing, and wherein the upper bearings are located between an upper bearing surface on the steering column and an inner bearing surface on the steering housing and wherein the lower bearings are located between a lower bearing surface on the steering column and a lower inner bearing surface on the steering housing.

14. The outboard motor according to claim 13, wherein the upper bearings and the lower bearings each comprises inner and outer races containing tapered roller bearings that extend transversely with respect to the steering axis.

15. The outboard motor according to claim 1, further comprising a driveshaft housing located above the steering housing.

16. An outboard motor comprising:

a powerhead configured to rotate a driveshaft;

a steering housing located below the powerhead;

a lower gearcase located below the steering housing and supporting a propeller shaft that is operably coupled to the driveshaft or an extension thereof so that rotation of the driveshaft or the extension thereof causes rotation of the propeller shaft, wherein the lower gearcase is steerable about a steering axis with respect to the steering housing;

a steering column fixed to the lower gearcase and extending upwardly into the steering housing; and a steering actuator coupled to the steering housing, wherein the steering actuator comprises a piston that is movable back and forth in a cylinder, and wherein the piston is engaged with the steering column such that back and forth movement of the piston causes rotation of the steering column and the lower gearcase about the steering axis.

17. The outboard motor according to claim 16, wherein the piston is engaged with the steering column via a yoke and a trunnion.

18. The outboard motor according to claim 17, wherein the trunnion is coupled to the yoke via a cylinder that is rotatable in the trunnion.

19. The outboard motor according to claim 17, wherein the piston comprises a pair of piston halves disposed on opposite sides of the trunnion.

20. The outboard motor according to claim 17, wherein the steering housing comprises a center-column and wherein the steering column extends upwardly into a through-bore in the center-column, and wherein the driveshaft or the extension thereof extends through the steering column and the through-bore in the center-column.

* * * * *